United States Patent [19]

Tiggesbaumker et al.

[11] 3,951,347

[45] Apr. 20, 1976

[54] APPARATUS FOR CRUSHING MATERIAL CONTAINING PARTICLES THAT ARE HARD TO PULVERIZE

[75] Inventors: Peter Tiggesbaumker, Oelde; Ludger Lohnherr, Diestedde, both of Germany

[73] Assignee: Polysius AG, Neubeckum, Germany

[22] Filed: Sept. 13, 1973

[21] Appl. No.: 396,855

[30] Foreign Application Priority Data

Sept. 21, 1972 Germany ..... 7239679[U]

[52] U.S. Cl. ..... 241/52; 241/79.1; 241/80; 241/119

[51] Int. Cl.[2] ..... B02C 13/14; B07B 13/00

[58] Field of Search ..... 241/52, 79, 79.1, 79.2, 241/80, 81, 119

[56] References Cited

UNITED STATES PATENTS

| | | | |
|---|---|---|---|
| 2,552,596 | 5/1951 | Sheldon | 241/52 X |
| 2,721,035 | 10/1955 | Lankford et al. | 241/79.1 |
| 3,078,050 | 2/1963 | Hardinge | 241/80 X |
| 3,231,204 | 1/1966 | Ferguson et al. | 241/80 X |

FOREIGN PATENTS OR APPLICATIONS

| | | | |
|---|---|---|---|
| 2,019,005 | 11/1971 | Germany | 241/79.1 |
| 922,801 | 1/1955 | Germany | 241/52 |

*Primary Examiner*—Roy Lake
*Assistant Examiner*—E. F. Desmond
*Attorney, Agent, or Firm*—Learman & McCulloch

[57] ABSTRACT

The invention concerns an apparatus for crushing, by means of a rotary mill, material containing particles that are difficult to pulverize. The mill has an air-sifter with pneumatic supply of ground material, where the coarse-material discharge of the air-sifter is connected to the intake side of the mill, and has a mechanical conveyor whose intake side is connected to the coarse-particle discharge of the mill and whose discharge is connected to the intake side of the mill.

14 Claims, 6 Drawing Figures

APPARATUS FOR CRUSHING MATERIAL CONTAINING PARTICLES THAT ARE HARD TO PULVERIZE

In a known rotary mill only the lighter, fine particle portion of the ground material is pneumatically transferred to the air-sifter, while the heavier, coarse-particle portion drops down unto a mechanical conveyor which returns all of it to the intake side of the mill. This method of operation provides merely a means of returning the coarse-particle portion of the mill discharge at a relatively small expense of energy, which cannot be achieved by a pneumatic transfer of the coarse material from the mill to the sifter.

In the crushing of soft to medium-hard material of the type encountered, for example, in the manufacture of cement and lime, it happens frequently that the charge contains particles which are hard and not readily pulverized, quartz for example. When these hard particles circulate in the mill for too long a period of time, the result is first an increased wear of the crushing tools of the rotary mill and, in addition, it can lead to a chemical contamination of the end product. Furthermore, the continuous recirculation of the hard particles increases substantially the coarse-material throughput to be handled by the mill, so that the transfer devices as well as the mill itself may become overloaded.

In another known rotary mill it has been attempted to remove these hard-to-pulverize particles. In this type of construction, a so-called shutter-sifter is mounted above the rotary mill. This sifter has a movable vane in its coarse-material discharge which diverts a portion of the coarse material discharged from the device, while the other portion is returned to the intake side of the mill. Above the shutter-sifter is mounted an air-stream-sifter in which a sharper separation of the pulverized material is meant to take place. In this mill the entire discharge from the mill is transferred pneumatically to the air-sifter. This known device has serious disadvantages. Since two air-sifters are mounted above each other, this type of design is more costly and often results in an undesirable construction height. Furthermore, in order to transfer all of the crushed material pneumatically into the two air-sifters, a considerable amount of energy is required. The energy requirements are additionally increased because a separation of the crushed material is to take place (i.e., a two-stage sifting) in the two sifters, one mounted above the other. Finally, the regulating vane in the coarse-material discharge is located practically below the coarse-material collection-cone of the shutter-sifter and the coarse material separated here drops down in rather irregular fashion (possibly even with a spinning motion), so that the amount of coarse material drawn off through the regulating vane is scarcely controllable.

The problem to be solved by the invention, therefore, is to avoid these shortcomings of the known constructions by the provision of a device in which at least a portion of the coarse material can be drawn off at a constant quantitative rate with a relatively small amount of power.

This problem is solved by the invention in the following way: a device for drawing off a controllable portion of the coarse material discharge of the mill is located between the coarse-material discharge of the mill and the intake side of the mill. Then, depending on the quantity of hard-to-pulverize particles in the raw material, a part or all of the mill discharge can thus be drawn off from the device. Since, as a rule, the hard-to-pulverize particles are also the largest coarse material particles, it is possible to draw off with great certainty at least the major portion of the hard-to-pulverize particles directly from the mill. The device for drawing off a part of the coarse material can then be advantageously located at a place at which the flow of material has a relatively uniform direction, so that an always constant portion of the coarse material (namely that determined by the setting) can be drawn off by a simple adjustment mechanism of the discharge device.

The inventive design conserves energy by using a mechanical conveyor to return to the mill intake side that portion of the coarse material which has not been discharged.

A very advantageous result is obtained when the device for drawing off an adjustable portion of the coarse material is located between the coarse material discharge of the mill and the intake side of the mechanical conveyor. To accomplish this, the mechanical conveyor can be designed for relatively small capacity.

In an apparatus according to the invention having a grinding plate as the grinding means of the mill, the grinding plate being provided with a circular slot for the supply of air for conveying and sifting material, it is furthermore useful to place within the circular slot an adjustable nozzle ring. Thus it is possible to obtain a preliminary sorting of the crushed material already within the mill, for example, such that the finely ground material and the finer portion of the coarse (raw) material are pneumatically transferred into the air-sifter, while only the coarser portion of the material flows through the coarse-material discharge passage of the mill.

Further details of the invention will become apparent from the following description when it is considered in conjunction with the accompanying drawings wherein:

FIG. 1 illustrates a rotary mill (crushing mill) 1 partly in section and partly in exterior view, an air sifter 2, as well as a mechanical conveyor, in this case shown as a bucket conveyor 3 mounted alongside the mill and windsifter.

Figure 1:
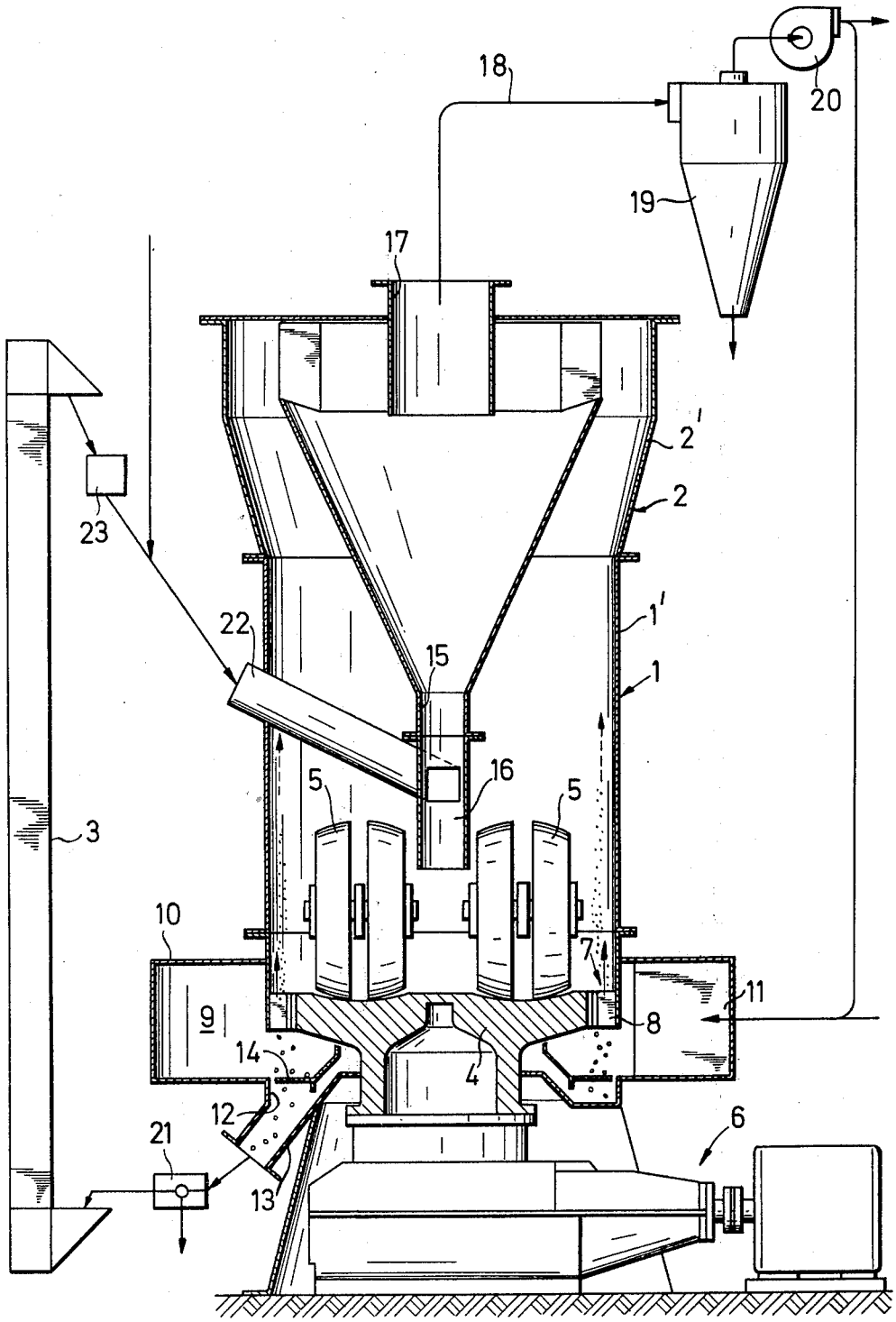
FIG. 1 is a schematic, sectional view of a rotary mill according to the invention.
Figure 2:
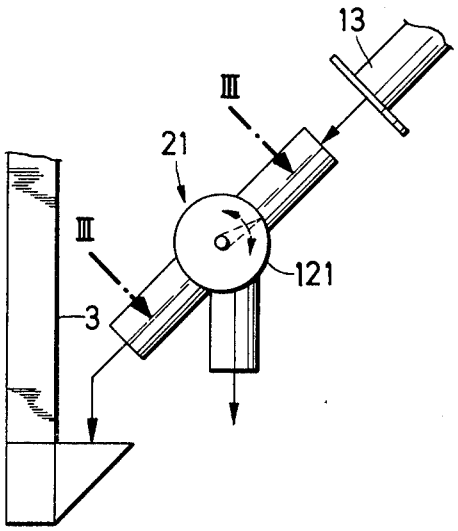
FIG. 2 is a schematic view of the simplest arrangement of a regulating device.
Figure 3:
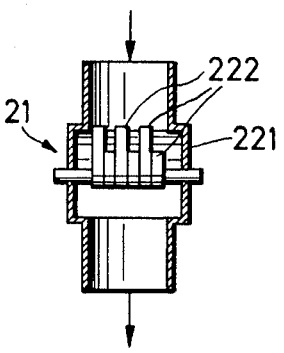
FIG. 3 is a sectional view of a modified regulating device.
Figure 4:
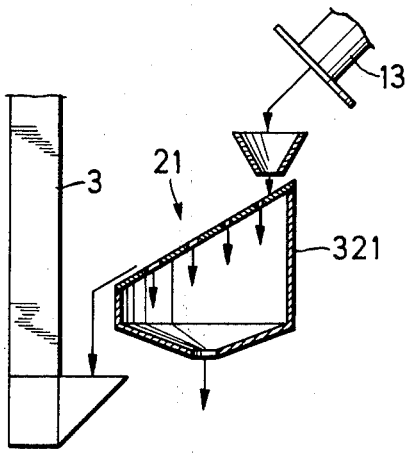
FIG. 4 is a schematic view of another embodiment of a regulating device.
Figure 5:
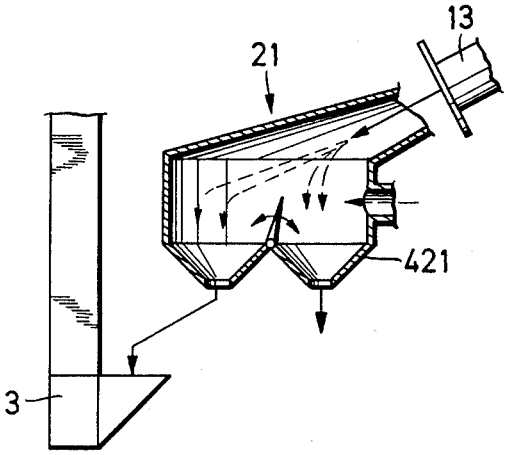
FIG. 5 is a schematic view of a further regulating device embodiment.
Figure 6:
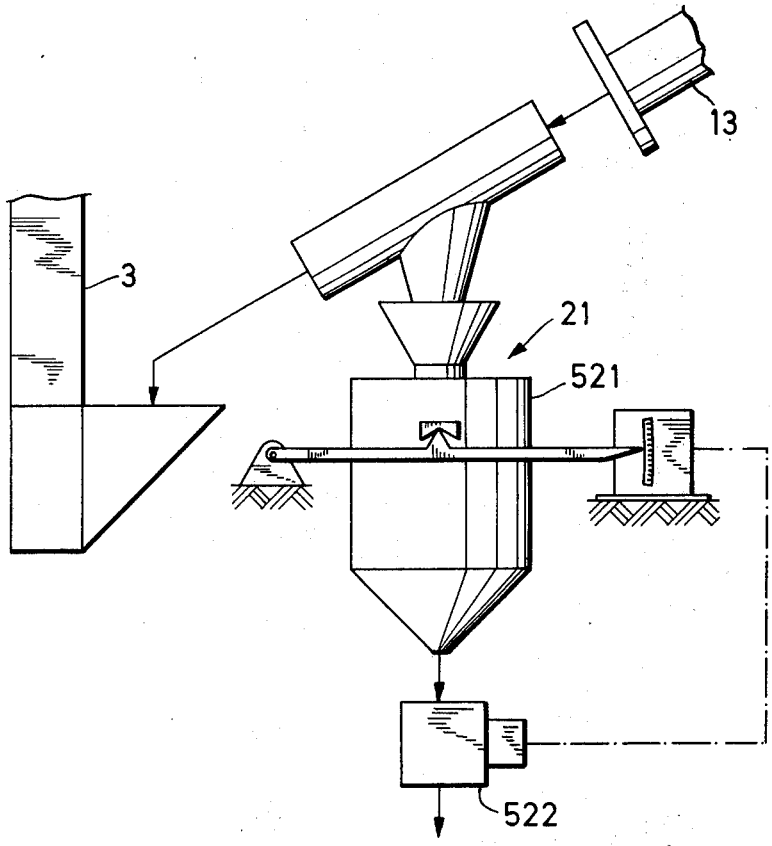
FIG. 6 is a schematic view of a weighing apparatus.

The rotary mill 1 is shown as a spring roller mill and contains a grinding plate 4 on which the rollers 5 move in customary fashion. The grinding plate is rotated from below by the drive 6. Circumventing the grinding plate 4 is a circular slot 7 within which is located an adjustable nozzle ring 8 through which flows the air for conveying and sifting material past the mill to the air sifter 2, while at least the larger particles of the coarse material can drop down through the slot. Below the nozzle ring is an annular chamber 9 formed by the casing 10; the diameter of chamber 9 is larger than the outside diameter of the nozzle ring 8. The space enclosed by casing 10 is used to supply air for conveying and sifting and also to discharge the coarse material from the mill. For these reasons, casing 10 has an air supply connection 11 and a bottom coarse particle discharge opening 12, to which is fastened a discharge chute 13 inclined downward and outwards. The casing 10 is so constructed that air passing through connection 11 is, at the outset, uniformly distributed in chamber 9, so that it can flow upwards through the nozzle ring, evenly distributed.

Above the bottom of casing 10 is provided a discharge device 14, which is fastened to grinding plate 4 and which rotates with the plate. This discharge device can, for example, be formed by one or more vanes or by an appropriately shaped discharge scoop; in any case, the device is built such that the coarse material dropping down through the nozzle ring 8 is brought to the discharge opening 12 and thus into the chute 13.

The air sifter 2 mounted above the mill 1 can be constructed in the usual fashion, such that its heavier material discharge 15 leads to the intake side 16 of the mill. The centrally located air and fine particle outlet or discharge nozzle 17 of the air sifter 2 is connected by means of a pipe 18 to a dust removing device 19, which is connected to a blower 20, which furnishes the air current for transporting and sifting material. If desired, the pressure side (discharge flange) of this blower can be connected to the air supply flange 11 of the mill, in which case the mill and sifter would operate with a recirculating air stream.

The mill 1 and the air sifter 2 with their casings 1' and 2' are connected together in such a way that the mill and air sifter are essentially coaxial.

The chute 13, through which the coarse material dropping down from the mill is discharged, is provided with a device 21 for the purpose of drawing off an adjustable portion of the coarse material. Depending on the use and construction of the invention, this device 21 can be constructed in different ways. In the simplest construction the device 21 contains a regulating shutter flap 121, rockably mounted in a passage through which the coarse material flows very evenly distributed (over the cross section).

However, the removal device 21 can also be built as an adjustable separator 221, in which, for example, individually adjustable finger-shutters 222 provide an extremely sensitive means of adjustment.

The device 21 can, however, also consist of a size grading screen device 321, or a weight sorting air stream device 421, in each of which a very sensitive separation takes place according to particle size or weight.

In any case, it frequently will be advisable to equip the device 21 with a weighing mechanism 521 which monitors the amount of coarse material drawn off. The weighing mechanism can then be coupled with a known device 522 for regulating the drawn off coarse material, whereby the regulation can be made to take into account, for example, either chemical and/or physical properties.

That portion of the coarse material which is not drawn off by means of the device 21, can then be transported by a relatively small mechanical conveyor to a charging chute 22, which returns the material to the intake 16 of the mill. It can then be advantageous to install a magnetic separator 23 on the discharge side of the bucket conveyor, so that pieces of metal, which might have become loosened in the bucket conveyor, cannot enter the mill. The charging chute 22 also supplies simultaneously the fresh raw material for mill 1. The method of operation of this invention should be understood without difficulty in the light of the above description in conjunction with the drawings.

However, it may be mentioned, that it is also possible, within the framework of this invention, to mount the device 21 for the removal of an adjustable portion of the coarse material between the discharge side of the mechanical conveyor and the intake side of the mill.

What is claimed is:

1. A rotary mill for crushing material containing hard to pulverize particles, said mill having a material intake, a fine particle outlet, and a coarse particle outlet; means for supplying to said intake material to be ground; means for grinding said material; pneumatic means for separating coarse and fine particles from the ground material and discharging fine particles through said fine particle outlet and discharging coarse particles through said coarse particle outlet; conveyor means for receiving discharged coarse particles and conveying them to said intake; and coarse particle removal means interposed between said outlet and said intake for removing a selected fraction of said coarse particles.

2. A mill according to claim 1 wherein said coarse material removal means is interposed between said discharge and said conveyor means.

3. A mill according to claim 1 wherein said coarse material removal means comprises a regulating shutter.

4. A mill according to claim 1 wherein said coarse material removal means comprises a plurality of finger shutters.

5. A mill according to claim 1 wherein said coarse material removal means includes means for weighing removed coarse material.

6. A mill according to claim 5 wherein said weighing means is coupled to a device for selecting the coarse material fraction to be removed according to its chemical or physical properties.

7. A mill according to claim 1 wherein said coarse material removal means comprises a device for grading said particles according to size.

8. A mill according to claim 1 wherein said coarse material removal means comprises a device for grading said particles according to weight.

9. A mill according to claim 1 including a rotatable grinding plate having a circular slot through which air may pass for conveying and sifting said material, and adjustable nozzle means arranged within said slot.

10. A mill according to claim 9 including a casing below said nozzle means, said casing having an air inlet and a bottom opening.

11. A mill according to claim 10 including a discharge device above said casing and coupled to said grinding plate for rotation therewith.

12. A mill according to claim 1 wherein said conveyor means comprises a bucket conveyor.

13. A mill according to claim 1 including magnetic separator means carried by said conveyor means.

14. A rotary mill for crushing material containing hard to pulverize particles, said mill having a material intake, a coarse particle outlet at a lower level of said mill, and a fine particle outlet at an upper level of said mill; means for supplying to said intake material to be ground; means for grinding said material; pneumatic means for separating coarse and fine particles from the ground material and discharging fine particles through said fine particle outlet; means for discharging coarse particles through the coarse particle outlet; conveyor means for receiving discharged coarse particles and conveying them to said intake; and coarse particle removal means interposed between said coarse particle outlet and said intake for removing a selected fraction of said coarse particles discharged through said coarse particle outlet.

* * * * *